US011930839B1

(12) United States Patent
Boss

(10) Patent No.: US 11,930,839 B1
(45) Date of Patent: Mar. 19, 2024

(54) CIGARETTE LOADING MACHINES AND METHOD THEREFORE

(71) Applicant: Dimitry Boss, Hillsdale, NJ (US)

(72) Inventor: Dimitry Boss, Hillsdale, NJ (US)

( * ) Notice: Subject to any disclaimer, the term of this patent is extended or adjusted under 35 U.S.C. 154(b) by 0 days.

(21) Appl. No.: 18/141,391

(22) Filed: Apr. 29, 2023

Related U.S. Application Data

(60) Provisional application No. 63/443,791, filed on Feb. 7, 2023.

(51) Int. Cl.
*A24D 1/02* (2006.01)
*A24D 1/18* (2006.01)

(52) U.S. Cl.
CPC ..... *A24D 1/027* (2013.01); *A24D 1/18* (2013.01)

(58) Field of Classification Search
None
See application file for complete search history.

(56) References Cited

U.S. PATENT DOCUMENTS

| | | | | |
|---|---|---|---|---|
| 2,667,170 | A | 1/1954 | Lebert | |
| 3,547,131 | A | 12/1970 | Dock | |
| 3,699,972 | A | 10/1972 | Frisch | |
| 3,924,643 | A | 12/1975 | Summers | |
| 4,406,294 | A | 9/1983 | Lamb | |
| 4,515,170 | A | 5/1985 | Cantrell | |
| 4,535,793 | A | 8/1985 | Luke | |
| 4,708,150 | A | 11/1987 | Lamb | |
| 5,062,434 | A | 11/1991 | Aulbach | |
| 5,394,895 | A | 3/1995 | Muramatsu | |
| 10,159,277 | B2 | 12/2018 | Bonnely | |
| 2010/0319718 | A1 | 12/2010 | Schlter | |
| 2012/0272979 | A1* | 11/2012 | Cooper | A24D 1/002 221/1 |
| 2019/0014813 | A1 | 1/2019 | Carraro | |
| 2020/0229489 | A1 | 7/2020 | Pillie | |
| 2021/0267267 | A1 | 9/2021 | Brifcani | |
| 2021/0289833 | A1 | 9/2021 | Moloney | |

FOREIGN PATENT DOCUMENTS

| | | | |
|---|---|---|---|
| CN | 114376265 | A | 4/2022 |
| DE | 102017122998 | A1 | 4/2018 |
| EP | 60488 | A1 | 9/1982 |
| EP | 1946659 | A1 | 7/2008 |
| EP | 2932860 | A1 | 10/2015 |

(Continued)

*Primary Examiner* — Phu H Nguyen
(74) *Attorney, Agent, or Firm* — QuickPatents; Kevin Prince

(57) ABSTRACT

An apparatus can manufacture cigarettes of the type having a frustoconical rolled paper with a proximal end thereof and open at a distal end thereof. A smokable material can be filled within the rolled paper. The apparatus includes an elongated, retractable rod extendable through either the open distal end or the proximal end of the rolled paper. With the retractable rod extended through the open distal end of the rolled paper, the rolled paper may be filled with the smokable material by the apparatus, compacted, and the retractable rod then retracted to leave an air channel through the smokable material in the cigarette. An adhesive may be sprayed on the smokable materials proximate the air channel to maintain the coherence of the air channel.

17 Claims, 6 Drawing Sheets

(56) References Cited

FOREIGN PATENT DOCUMENTS

| | | | |
|---|---|---|---|
| GB | 201021544 | A | 12/2010 |
| KR | 200409770 | Y1 | 3/2006 |
| KR | 200437887 | Y1 | 1/2008 |
| KR | 102343349 | B1 | 12/2021 |
| WO | 2020181577 | A1 | 9/2020 |
| WO | 2020220507 | A1 | 11/2020 |
| WO | 2021128830 | A1 | 7/2021 |
| WO | 2022074115 | A1 | 4/2022 |
| WO | 2022074133 | A1 | 4/2022 |

* cited by examiner

CIGARETTE LOADING MACHINES AND METHOD THEREFORE

CROSS-REFERENCE TO RELATED APPLICATIONS

This application claims the benefit of U.S. Provisional Patent Application 63/443,791, filed on Feb. 7, 2023, and is incorporated herein by reference.

STATEMENT REGARDING FEDERALLY SPONSORED RESEARCH AND DEVELOPMENT

Not Applicable.

FIELD OF THE INVENTION

This invention relates to cigarette manufacturing, and more particularly to an improvement for an apparatus that manufactures cigarettes.

BACKGROUND

Cigarette manufacturing machines for making so-called joints or blunts with marijuana typically use a cone-shaped or frustoconical-shaped rolled paper, either having a filter or not. Such the cigarette manufacturing machine fills the rolled paper from an open end of the rolled paper, and compresses the smoking material, users often find it difficult to draw sufficient air through the cigarette and the cigarette often extinguishes. Having air channels or some other means of producing a lower-resistance airflow path would be desirable.

Therefore, there is a need for a device that produces an air channel through a rolled paper cigarette easily and quickly during the manufacturing process of such cigarettes. Such a needed invention would be incorporated into existing and new rolling and filling machines to allow for a fully automated process. The present improvement for such rolling and filling machines or group of machines accomplishes these objectives.

SUMMARY OF THE INVENTION

The present invention is an improvement for an apparatus that manufactures cigarettes of the type having a frustoconical rolled paper with or without a filter at a proximal end thereof and open at a distal end thereof, a smokable material to be filled within the rolled paper, the improvement including an elongated, retractable rod disposed within the apparatus and extendable through either end of the rolled paper. With the retractable rod extended through the rolled paper, the rolled paper may be filled with the smokable material by the apparatus, the retractable rod then retracted to leave an air channel through the smokable material in the cigarette. Alternately, the retractable rod may be inserted into the rolled paper after the smokable materials are loaded therein.

In some embodiments, the retractable rod may be substantially hollow and includes a plurality of apertures therethrough, an adhesive being pumped therethrough to exit the apertures and adhere the smokable material. Upon retraction of the retractable rod the air channel in the smokable material remains cohesive in large part due to the adhesive. In some embodiments, the adhesive may be a plant extract-based, such as a concentrated THC extract, or an extract from another part of the marijuana plant, or other adhesive.

In some embodiments, the improvement may include an outer retractable rod surrounding the retractable rod and configured for retraction independently of the retractable rod. With the retractable rod and the outer retractable rod fully extended, the outer retractable rod may be retracted first to expose the retractable rod to the smokable materials, the adhesive thereafter being sprayed onto the smokable material with a gap between the smokable materials and the retractable rod. Thereafter the retractable rod is retracted. In some embodiments, the retractable rod may be inserted into and retracted from the proximal end of the rolled paper by the apparatus. In alternate embodiments, the retractable rod may be inserted into and retracted from the open distal end of the rolled paper by the apparatus.

Embodiments of the present disclosure may also include a method of filling a cigarette with smokable material, the cigarette including a frustoconical rolled paper with or without a filter at a proximal end thereof and open at a distal end thereof, the method including the first step of providing the apparatus for filling the cigarette with the smokable material.

Next, an empty rolled paper is loaded into the apparatus. The apparatus then extends the retractable rod through the rolled paper and then fills the rolled paper with the smokable material. The apparatus then retracts the retractable rod to leave an air channel through the smokable material in the cigarette.

In some embodiments, the retractable rod may be substantially hollow and includes a plurality of apertures therethrough, the method further including the steps spraying an adhesive, such as a concentrated THC extract or other plant-based adhesive, through the retractable rod to exit the apertures and adhere the smokable material.

The method may include the step of providing an outer retractable rod surrounding the retractable rod and configured for retraction independently of the retractable rod. In such an embodiment the outer retractable rod and the retractable rod are fully extended into the rolled paper. The apparatus fills the rolled paper with the smokable materials, and then retracts the outer retractable rod to expose the smokable materials to the retractable rod and the apertures. The adhesive is sprayed or spun onto the smokable material so that the remaining air channel caused by the retractable rods ensures. In some embodiments, the method may include the step dispensing air through the apertures of the retractable rod to aid in drying the adhesive.

The present invention is a device that produces an air channel through a rolled paper cigarette easily and quickly during the manufacturing process of such cigarettes. The present invention can be incorporated into existing rolling and filling machines to allow for a fully automated process. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
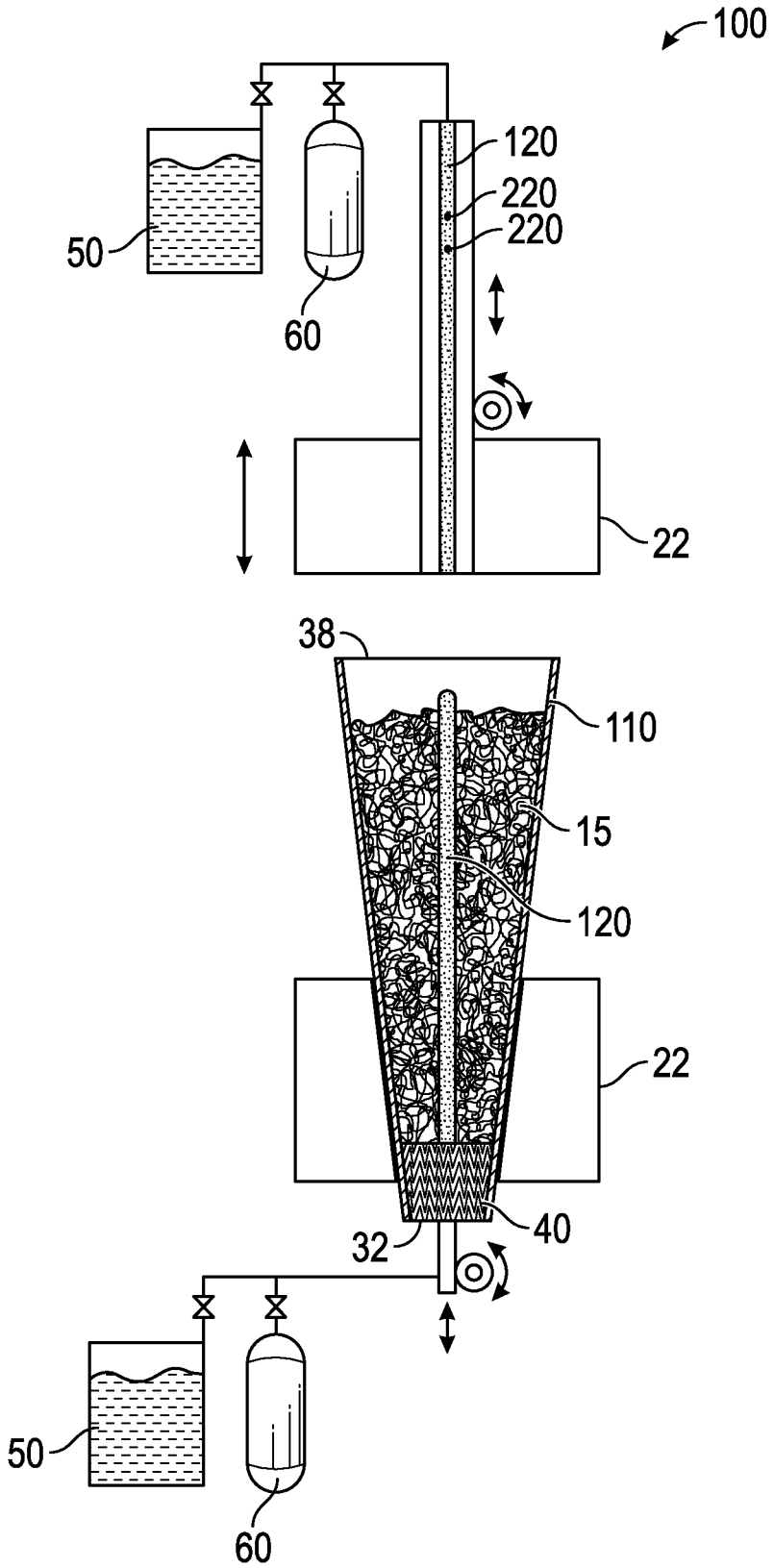
FIG. 1 is a diagram illustrating an improvement, according to some embodiments of the present disclosure.

FIG. 1 is a diagram that describes an improvement 100 for an apparatus 20 that manufactures cigarettes 25 of the type having a frustoconical rolled paper 110 with or without a filter 40 at a proximal end 32 thereof, and open at a distal end 38 thereof. A smokable material 15, such as tobacco or marijuana, is to be filled within the rolled paper 110. The improvement 100 includes an elongated, retractable rod 120 disposed within the apparatus 20 and extendable through either end 32,38 of the rolled paper 110. With the retractable rod 120 extended through the rolled paper 110, the rolled paper 110 may be filled with the smokable material 15 by the apparatus 20, the retractable rod 120 then retracted to leave an air channel 26 through the smokable material in the cigarette 25.

In some embodiments, the retractable rod 120 may be inserted into and retracted from the proximal end 32 of the rolled paper 110 by the apparatus 20. In some embodiments, the retractable rod 120 may be inserted into and retracted from the open distal end 38 of the rolled paper 110 by the apparatus 20. In alternate embodiments, the retractable rod 120 may be inserted into the cigarette 25, at either the proximal end 32 or the distal end 38, after the smokable material 15 is loaded therein.

Figure 2:
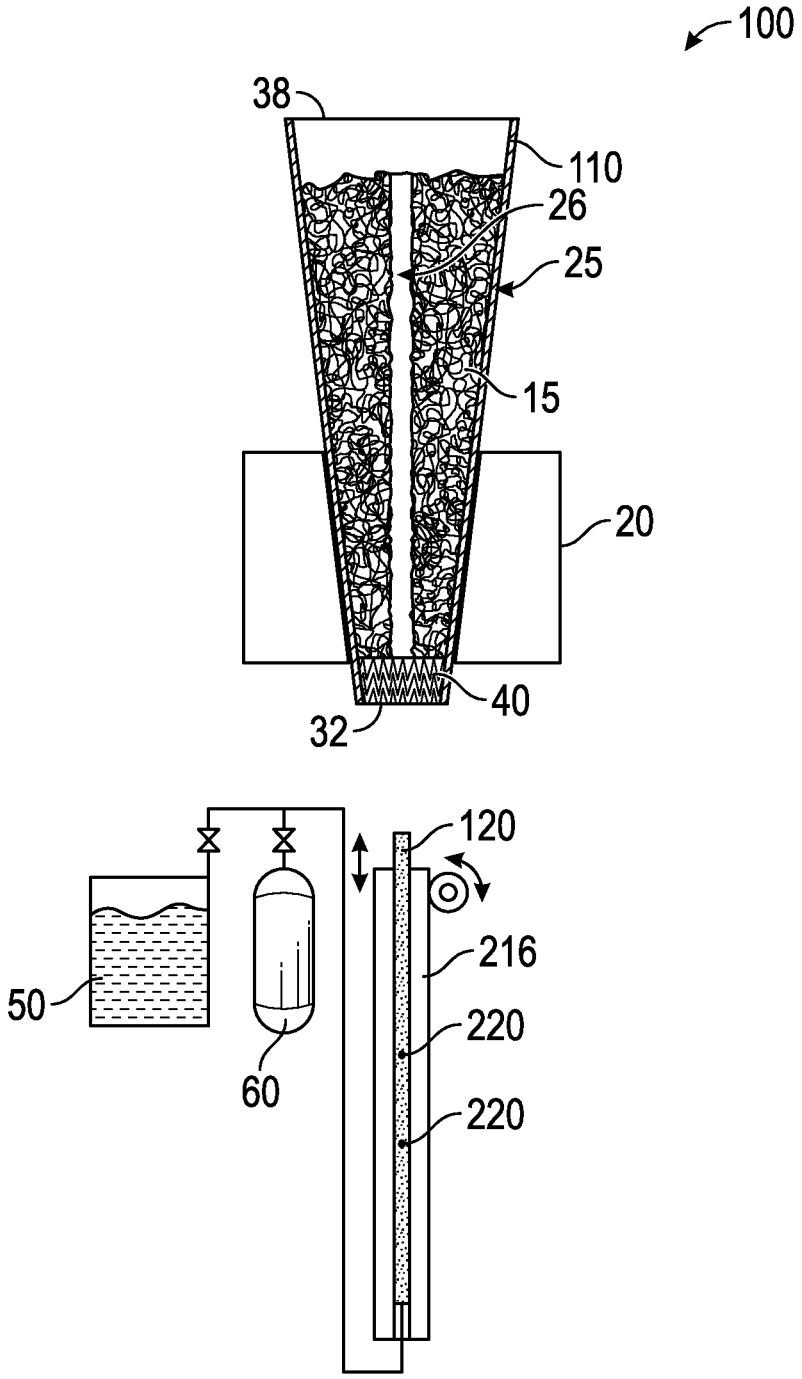
FIG. 2 is a diagram further illustrating the improvement from FIG. 1, according to some embodiments of the present disclosure.
Figure 6:
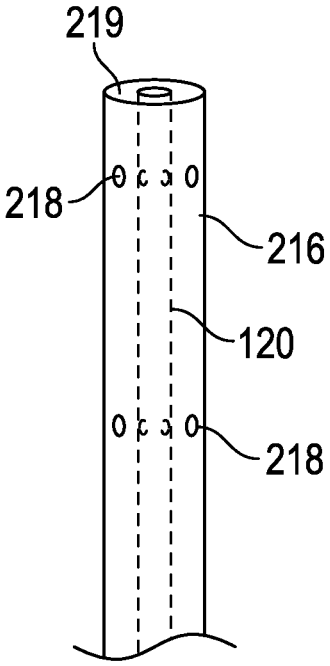
FIG. 6 is a diagram illustrating an outer retractable rod of the apparatus of FIG. 1.

FIG. 2 is a diagram that further describes the improvement 100 from FIG. 1, according to some embodiments of the present disclosure. In some embodiments, the retractable rod 120 may be substantially hollow. Upon retraction of the retractable rod 120 the air channel 26 in the smokable material 15 may remain cohesive. In some embodiments, the improvement 100 may include an outer retractable rod 216 surrounding the retractable rod 120 and configured for retraction independently of the retractable rod 120. When the retractable rod 120 and the outer retractable rod 216 are extended, the outer retractable rod 216 may be retracted first to expose the retractable rod 120 and the apertures 220 to the smokable materials 15, an adhesive 50 thereafter being sprayed onto the smokable material 15, thereafter the retractable rod 120 being retracted. In some embodiments, the outer retractable rod 216 may include an end that has a diameter larger than the diameter of the outer retractable rod 216 itself. This overhang lip 219 (see FIG. 6) may help maintain the space between the retractable rod 120 and the outer retractable rod 216 after the outer retractable rod 216 is retracted and the retractable rod 120 remains within the filter paper. In some embodiments, as shown in FIG. 6, the outer retractable rod 216 may include apertures 218, as can be seen. In some embodiments, the adhesive 50 and/or air 60 may be provided through the apertures 218 in the outer retractable rod 216 to provide a larger air channel 26.

In some embodiments, the outer retractable rod 216 (or the filter paper with the smokable materials 15 therein) may rotate. Typically, the rotation may occur after the adhesive 50 is introduced to help evenly spread the adhesive 50. In some embodiments, the rotation may continue as the outer retractable rod 216 is removed from the smokable materials 15.

Figure 4:
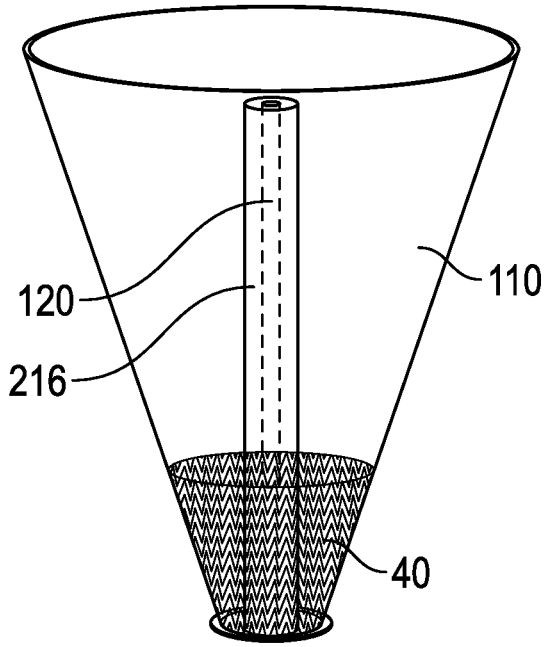
FIG. 4 is a diagram illustrating a zig-zag filter element at one end of the rolled paper of the apparatus of FIG. 1, according to an embodiment of the present disclosure.
Figure 5:
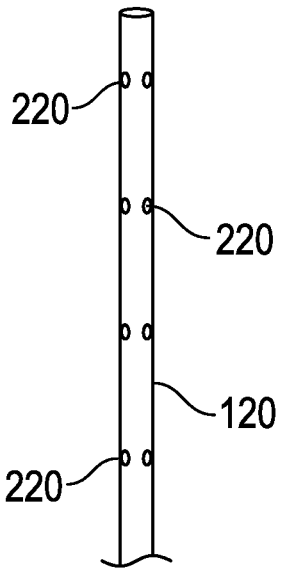
FIG. 5 is a diagram illustrating an inner retractable rod of the apparatus of FIG. 1.

In some embodiments, the filter 40 can have zig-zag pattern (as shown in FIG. 4), spiral, or radial pattern. In some embodiments, the filter 40 may be a structural element to prevent the proximal end of the cone from collapsing when being used. The apparatus 100 may position the cone so that the rods miss the elements within this filter/structural element when being inserted. In some embodiments, the apparatus can detect resistance to insertion and may automatically reposition the rods to permit insertion through the filter 40.

Figure 3:
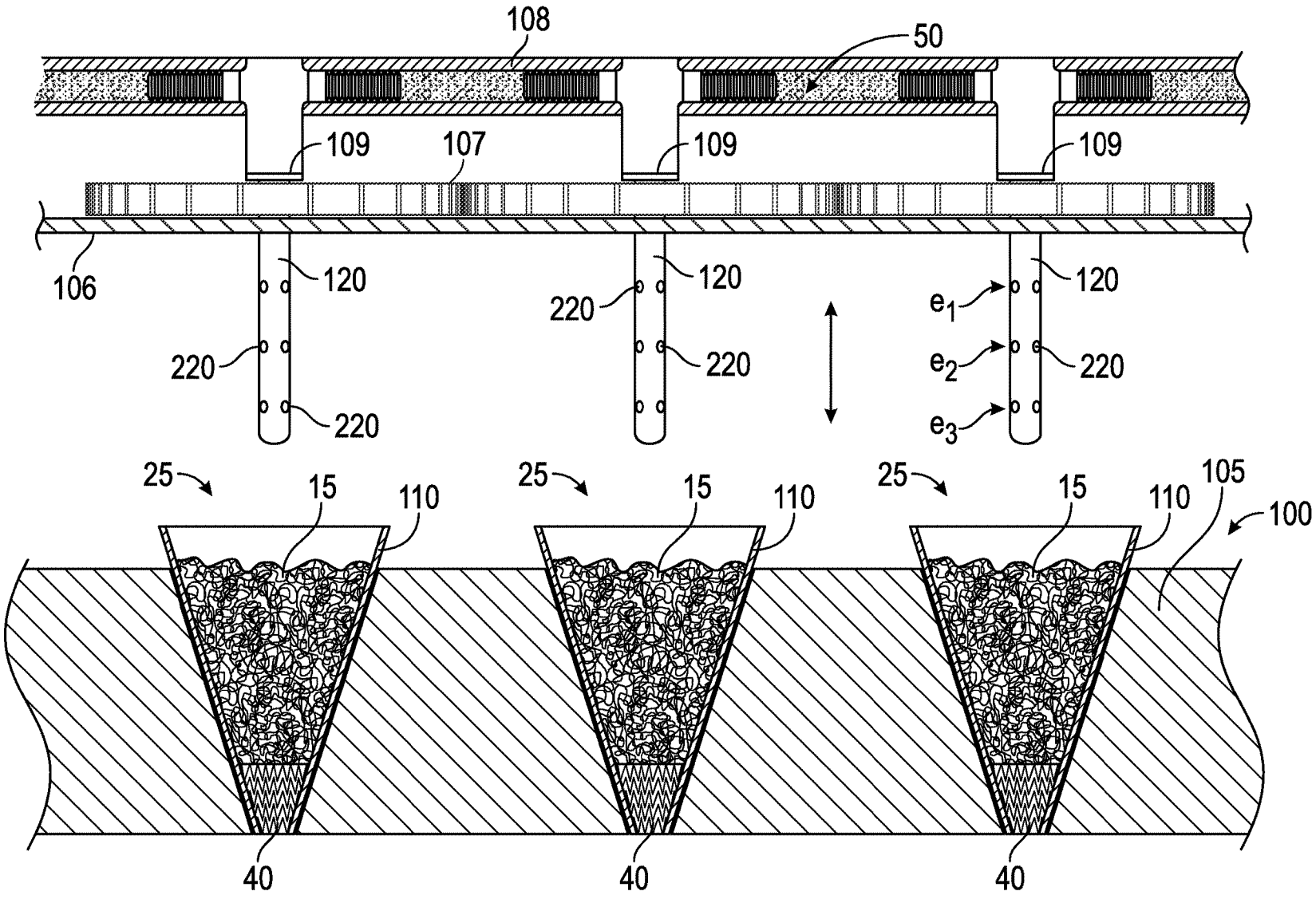
FIG. 3 is a partial cross-sectional view of an alternate embodiment of the invention.

In some embodiments, wherein a plurality of the cigarettes 25 are fixed in a fixture 105 (FIG. 3), a plurality of the retractable rods 120 are rotatably fixed in a frame 106 with each retractable rod 120 being rotatably driven through a gearing arrangement 107, or the like, for rotating the retractable rods 120 by at least 90-degrees. Preferably in such an embodiment there are a plurality of apertures 220 at common elevations, for example $e_1$-$e_3$, along the retractable rods 120 wherein a maximum amount of rotation of each retractable rod 120 is equal to 360 degrees divided by the number of apertures 220 at each common elevation $e_x$. For example, if there are four apertures 220 uniformly spaced around each common elevation along the retractable rod 120, then 360 degrees divided by four is equal to 90-degrees.

As such, inserting the retractable rods 120 into the smokable material 15, while rotating the retractable rods 120 with the gearing arrangement 107 repeatedly back and forth 90-degrees, and while also pumping the adhesive 50 into the retractable rods 120 will provide a substantially even distribution of the adhesive 50 about each air channel 26. Such a frame 106 and gearing arrangement 107 may include conduits 108 with rotatable seals 109 to allow the adhesive 50 to flow through the conduits 108, the retractable rods 120, and apertures 220. The frame 106 may be incorporated as part of a larger assembly machine (not shown), utilized as a manual hand-held device, or may be part of a semi-automated device (not shown). The means for pumping the adhesive 50 through the conduits 108 may be an electric pump, a manually-actuated squeeze pump, a gravity feed arrangement, or the like as is known in the art. The gearing arrangement 107 may include gears as illustrated, or a pulley/belt type system, or other means as is known in the art for rotating a plurality of the retractable rods 120 simultaneously, although not necessarily each in the same direction.

Figure 7:
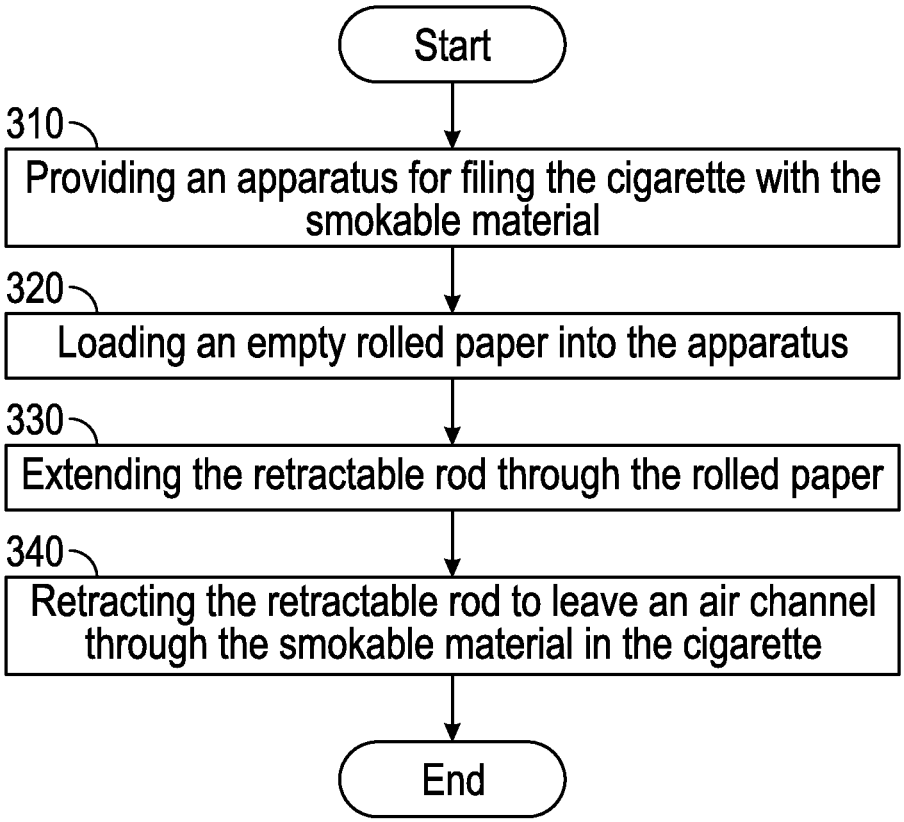
FIG. 7 is a flowchart illustrating a method of filling a cigarette, according to some embodiments of the present disclosure.

FIG. 7 is a flowchart that describes a method of filling a cigarette 25, according to some embodiments of the present disclosure. The cigarette 25 is made with a frustoconical rolled paper 110 with or without a filter 40 at a proximal end 32 thereof and open at a distal end 38 thereof. In some embodiments, at 310, the method includes providing an apparatus 20 for filling filing the cigarette 25 with the smokable material 15, the apparatus 20 including an elongated, retractable rod 120 disposed within the apparatus 20 and extendable through either the proximal end 32 of the rolled paper 110 to at least the filter 40 or the open distal end 38 of the rolled paper 110. At 320, the method includes loading an empty rolled paper 110 into the apparatus 20. At 330, the method includes extending the retractable rod 120 through the rolled paper 110. At 335 the method includes the apparatus 20 filling the rolled paper 110 with the smokable materials 15, although this step could occur before 330 in some embodiments. The apparatus 20 may also compact the smokable materials 15 with a compactor 22, as is known in the art. At 340, the method includes retracting the retractable rod 120 to leave an air channel 26 through the smokable material 15 in the cigarette 25.

Figure 8:
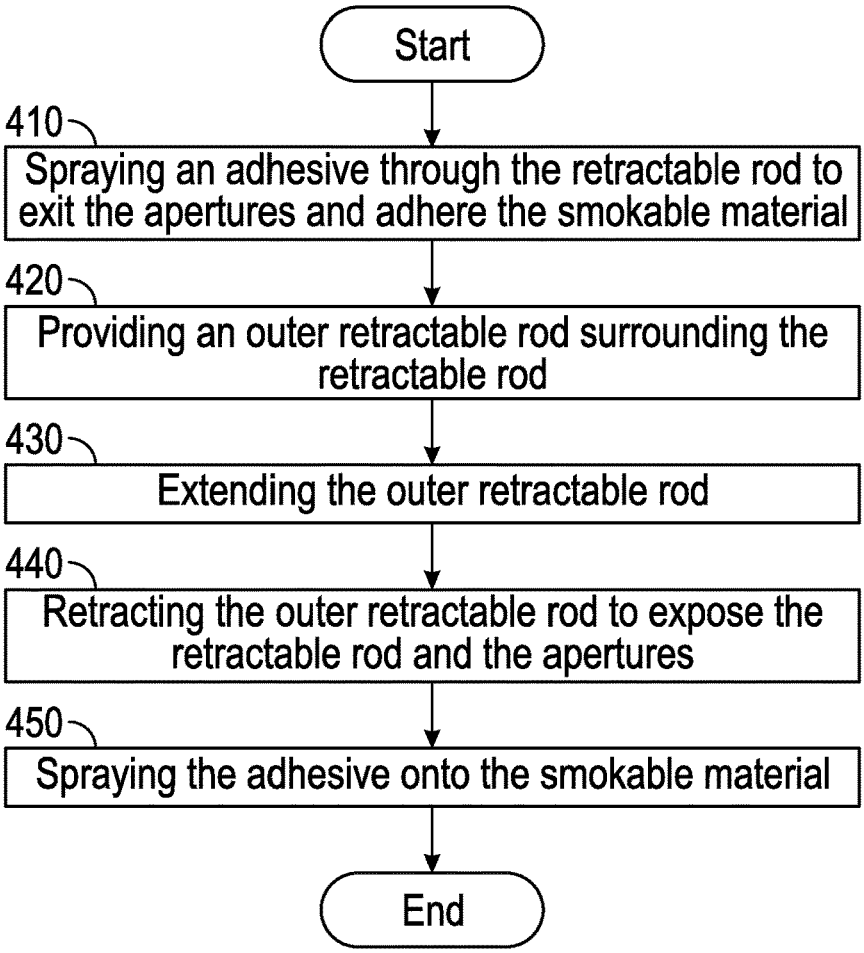
FIG. 8 is a flowchart further illustrating the method of filling a cigarette from FIG. 7, according to some embodiments of the present disclosure.

FIG. 8 is a flowchart that further describes the method of filling a cigarette from FIG. 7, according to some embodiments of the present disclosure. In some embodiments, the retractable rod 120 may be substantially hollow, with a plurality of apertures 220 therethrough. At 410, the method includes spraying an adhesive 50 through the retractable rod 120 to exit the apertures 220 and adhere the smokable material 15. In some embodiments, at 420, the method may include providing an outer retractable rod 216 surrounding the retractable rod 120 and configured for retraction independently of the retractable rod 120. At 430, the method may include extending the outer retractable rod 216. At 435 the method includes the apparatus 20 filling the rolled paper 110 with the smokable materials 15. The apparatus 20 may also compact the smokable materials 15 with a compactor 22, as is known in the art. At 440, the method may include retracting the outer retractable rod 216 to expose the retractable rod 120 and the apertures 220. At 450, the method may include spraying the adhesive 50 onto the smokable material 15.

Figure 9:
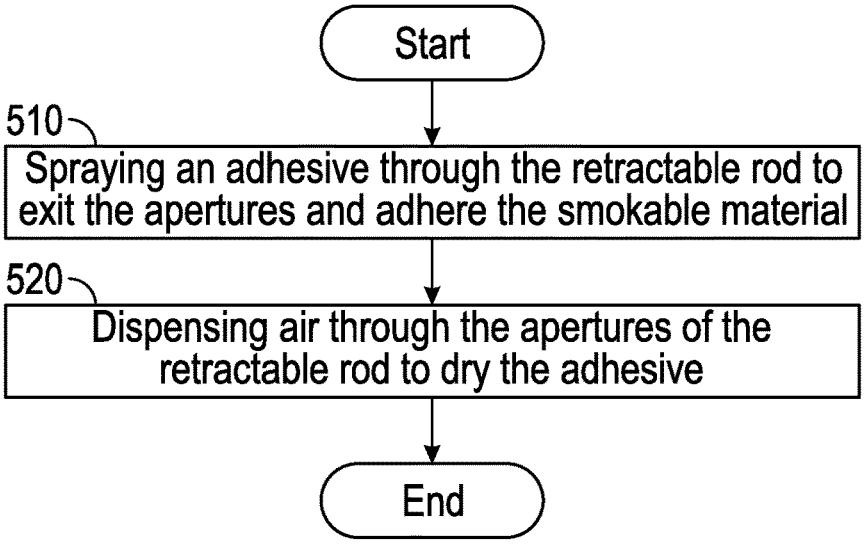
FIG. 9 is a flowchart further illustrating the method of filling a cigarette from FIG. 7, according to some embodiments of the present disclosure.

FIG. 9 is a flowchart that further describes the method of filling a cigarette 25 from FIG. 7, according to some embodiments of the present disclosure. In some embodiments, the retractable rod 120 may be substantially hollow and have a plurality of apertures 220 therethrough. At 510, the method may include spraying an adhesive 50 through the retractable rod 120 to exit the apertures 220 and adhere the smokable material 15. In some embodiments, at 520, the method may include dispensing air 60 through the apertures 220 of the retractable rod 120 to dry the adhesive 50.

While a particular form of the invention has been illustrated and described, it will be apparent that various modifications can be made without departing from the spirit and scope of the invention. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. An apparatus for manufacturing cigarettes, comprising:

an elongated, retractable rod extendable longitudinally through a rolled paper of a cigarette, the rolled paper having a proximal end thereof and an open distal end thereof, the retractable rod extendable through either the proximal end or the open distal end of the rolled paper;

wherein the retractable rod is surrounded by a smokable material within the rolled paper of the cigarette when the retractable rod is extended through the rolled paper, wherein the retractable rod is operable to be retracted from the cigarette to provide an air channel through the smokable material, and wherein the air channel is maintained through the smokable material upon retraction of the retractable rod wherein the retractable has a hollow interior and includes a plurality of apertures fluidly connecting the hollow interior with an exterior of the retractable rod; wherein the apparatus further comprising an adhesive operable to be pumped through the hollow interior of the retractable rod to exit the plurality of apertures and adhere to the smokable material, wherein the adhesive helps maintain the air channel through the smokable material upon retraction of the retractable rod.

2. The apparatus of claim 1, wherein the apparatus is configured to first extend the retractable rod into the rolled paper of the cigarette and then fill the rolled paper with the smokable material.

3. The apparatus of claim 1, wherein the apparatus is configured to first fill the rolled paper of the cigarette with the smokable material and then extend the retractable rod into the rolled paper.

4. The apparatus of claim 1, wherein the adhesive is a marijuana plant-based adhesive.

5. The apparatus of claim 1, further comprising:

an outer retractable rod surrounding the retractable rod, wherein the outer retractable rod is configured for retraction from the cigarette independently of the retractable rod;

whereby when the retractable rod and the outer retractable rod are extended into the rolled paper of the cigarette, the outer retractable rod is operable to be retracted from the cigarette first to expose the retractable rod and the plurality of apertures thereof to the smokable material.

6. The apparatus of claim 1, wherein the retractable rod is inserted into and retracted from the proximal end of the rolled paper of the cigarette by the apparatus.

7. The apparatus of claim 1, wherein the retractable rod is inserted into and retracted from the open distal end of the rolled paper of the cigarette by the apparatus.

8. The apparatus of claim 1 further including a fixture adapted to hold a plurality of the cigarettes, a plurality of the retractable rods being rotatably fixed with a frame, each of the retractable rods rotatably driven through a gearing arrangement that is configured to rotate each retractable rod by at least 90-degrees, each retractable rod fixed with a conduit through which the adhesive is pumped while the gearing arrangement rotates the retractable rods, whereby insertion of the retractable rods into the rolled paper of the cigarettes and then withdrawal thereof forms the air channel through the smokable material in each of the cigarettes.

9. An apparatus for manufacturing cigarettes, comprising:

an elongated, retractable rod having a hollow interior and including a plurality of apertures fluidly connecting the hollow interior with an exterior of the retractable rod, the retractable rod extendable longitudinally through a rolled paper of a cigarette, the rolled paper having a proximal end thereof and an open distal end thereof, the retractable rod extendable through either the proximal end or the open distal end of the rolled paper;

wherein the retractable rod is surrounded by a smokable material within the rolled paper of the cigarette when the retractable rod is extended through the rolled paper;

the apparatus further comprising an adhesive operable to be pumped through the hollow interior of the retractable rod to exit the plurality of apertures and adhere to the smokable material;

wherein, upon the adhesive exiting the plurality of apertures of the retractable rod, the retractable rod is operable to be retracted from the cigarette to provide an air channel through the smokable material, and wherein the adhesive helps maintain the air channel through the smokable material upon retraction of the retractable rod.

10. The apparatus of claim 9, wherein the apparatus is configured to first extend the retractable rod into the rolled paper of the cigarette and then fill the rolled paper with the smokable material.

11. The apparatus of claim 9, wherein the apparatus is configured to first fill the rolled paper of the cigarette with the smokable material and then extend the retractable rod into the rolled paper.

12. The apparatus of claim 9, wherein the apparatus is configured to rotate the retractable rod while the retractable rod is retracted from the cigarette.

13. An apparatus for manufacturing cigarettes, comprising:

an elongated, retractable rod having a hollow interior and including a plurality of apertures fluidly connecting the hollow interior with an exterior of the retractable rod;

an elongated, outer retractable rod surrounding the retractable rod, the outer retractable rod having an interior receiving the retractable rod therein and including a plurality of apertures fluidly connecting the interior of the outer retractable rod with an exterior of the outer retractable rod;

wherein the retractable rod and the outer retractable rod are extendable longitudinally through a rolled paper of a cigarette, the rolled paper having a proximal end thereof and an open distal end thereof, the retractable rod and the outer retractable rod extendable through either the proximal end or the open distal end of the rolled paper;

wherein the retractable rod and the outer retractable rod are surrounded by a smokable material within the rolled paper of the cigarette when the retractable rod and the outer retractable rod are extended through the rolled paper;

the apparatus further comprising an adhesive operable to be pumped through the interior of the outer retractable rod to exit the plurality of apertures thereof and adhere to the smokable material;

the apparatus further comprising air operable to be dispersed through the hollow interior of the retractable rod to exit the plurality of apertures thereof and dry the adhesive adhered to the smokable material;

wherein, upon the adhesive exiting the plurality of apertures of the outer retractable rod, the outer retractable rod is operable to be retracted from the cigarette independently of the retractable rod;

wherein, upon the outer retractable rod retracting from the cigarette independently of the retractable rod, the retractable rod is operable to disperse the air through the plurality of apertures thereof to dry the adhesive adhered to the smokable material, and then be retracted from the cigarette to provide an air channel through the smokable material, and wherein the dried adhesive helps maintain the air channel through the smokable material upon retraction of the retractable rod.

14. The apparatus of claim 13, wherein the apparatus is configured to first extend the retractable rod and the outer retractable rod into the rolled paper of the cigarette and then fill the rolled paper with the smokable material.

15. The apparatus of claim 13, wherein the apparatus is configured to first fill the rolled paper of the cigarette with the smokable material and then extend the retractable rod and the outer retractable rod into the rolled paper.

16. The apparatus of claim 13, wherein the apparatus is configured to rotate the outer retractable rod while the outer retractable rod is retracted from the cigarette independently of the retractable rod.

17. The apparatus of claim 13, wherein the adhesive is a marijuana plant-based adhesive.

* * * * *